United States Patent [19]

Lombardi

[11] Patent Number: 4,794,767

[45] Date of Patent: Jan. 3, 1989

[54] CIRCULAR KNIT TWO-LAYER UPHOLSTERY FABRIC AND METHOD

[76] Inventor: Victor J. Lombardi, 2715 Charlotte Ln., Burlington, N.C. 27215

[21] Appl. No.: 85,139

[22] Filed: Aug. 14, 1987

[51] Int. Cl.[4] ..... D04B 9/16; D04B 1/04

[52] U.S. Cl. ..... 66/190; 28/155; 66/202

[58] Field of Search ..... 66/169 R, 190, 191, 66/202; 28/155

[56] References Cited

U.S. PATENT DOCUMENTS

| | | | |
|---|---|---|---|
| 1,831,964 | 11/1931 | Lombardi | 66/190 |
| 2,105,301 | 1/1938 | Saftlas | 66/190 |
| 2,176,533 | 10/1939 | Logan | 66/190 X |
| 3,115,693 | 12/1963 | Chandler | 66/202 X |
| 4,096,609 | 6/1978 | Sayre | 28/155 |

OTHER PUBLICATIONS

"Knitting Times", Oct. 23, 1972, vol. 41, No. 44, pp. 75, 76, and 77.

*Primary Examiner*—Wm. Carter Reynolds

*Attorney, Agent, or Firm*—Bell, Seltzer, Park & Gibson

[57] ABSTRACT

The circular knit two-layer upholstery fabric of the present invention has stability and limited stretchability in both coursewise and walewise directions to meet established industry standards. The fabric includes a first layer knit of thermoplastic base yarn and forming stitch loops in wales of successive courses to provide a technical face side. A second layer is formed of lay-in yarn extending generally coursewise and in a sinuous manner along the juncture of the stitch loops of certain courses of the first layer and provides a technical back side constituting the exposed wear surface of the fabric. The lay-in yarn is in the range of two to ten times larger than the base yarn so that the lay-in yarn substantially covers the base yarn and provides the tactile characteristics, appearance and hand of the lay-in yarn constituting the exposed wear surface of the fabric.

19 Claims, 2 Drawing Sheets

CIRCULAR KNIT TWO-LAYER UPHOLSTERY FABRIC AND METHOD

FIELD OF THE INVENTION

This invention relates generally to a circular knit two-layer upholstery fabric and method of forming the same and more particularly to such a fabric having stability and limited stretchability in both coursewise and walewise directions and including a first layer knit of thermoplastic base yarn providing a technical face side and a second layer formed of lay-in yarn extending generally coursewise and providing a technical back side constituting the exposed wear surface of the fabric.

BACKGROUND OF THE INVENTION

Because of the dimensional stability required in upholstery fabric, it has been the common practice to utilize woven and warp knitted fabrics for home furnishings, contract, and automotive upholstery applications where the maximum standard for shrinkage in either direction has been established at five percent and the maximum standard for gain in either direction at two percent. However, fabrics of these general constructions are produced from yarns fed from multi-yarn creels or from yarns wound on large beams so that it is generally difficult to readily produce short production runs of a particular style. Also, with these approaches, a relatively long machine down-time is required when changing from one pattern to another in the production of these types of fabrics.

Recognizing the inherent flexibility and resultant advantages of producing upholstery fabric by circular knitting, the broad patterning possibilities it makes possible, and the ability to use novelty yarns in an unlimited range of synthetic and natural fiber combinations, others have proposed to produce upholstery fabric on circular knitting machines. However, as far as is known, these attempts have not met with widely accepted commercial success primarily because the circular knit fabrics have not met the rigid standards for shrinkage and stability so that most of the upholstery fabric currently being produced is either woven on a loom or produced on warp knit equipment.

U.S. Pat. No. 3,115,693 discloses a circular knit fabric which is said to be adapted for use as upholstery and the like. The knit fabric of this patent includes a base yarn forming stitch loops in the wales of successive courses and with the same type of yarn being inlaid along the juncture of the stitch loops of successive courses so that the inlaid yarn appears primarily on the technical back side of the fabric and constitutes the exposed wear surface of the fabric. However, by utilizing the same synthetic fiber type as a yarn component in both the basic knit structure and the lay-in yarn forming the exposed wear surface of the fabric, there is no appreciable contrast between the ( yarns; therefore, the resulting fabric has substantially the same characteristics on both its technical face side and technical back side as the characteristics of the respective base and lay-in yarns utilized in forming the knit fabric. Thus, the knit fabric produced in accordance with this patent does not provide the desired tactile characteristics, appearance and hand of commercially acceptable woven and warp knit upholstery fabrics.

BRIEF SUMMARY OF THE INVENTION

With the foregoing in mind, it is an object of the present invention to provide a circular knit two-layer upholstery fabric and method of forming the same wherein the knit fabric includes a technical face side knit of a base yarn and a technical back side formed of a lay-in yarn which is larger than the base yarn so that (the lay-in yarn constitutes the exposed wear surface of the fabric and substantially covers the base yarn and provides the tactile characteristics, appearance and hand of the lay-in yarn constituting the exposed wear surface of the fabric.

The knit two-layer upholstery fabric of the present invention includes a first layer knit of thermoplastic base yarn and forming stitch loops in wales of successive courses to provide a technical face side of the fabric. The thermoplastic base yarn may, for example, be polyester or nylon, or include components thereof, heat-settable in the 360°-380° F. temperature range; or the thermoplastic base yarn may be a polypropylene, generically, an olefin, or include a component thereof, heat-settable in the 260°-280° F. temperature range. A second layer is formed of lay-in yarn extending generally coursewise and in a sinuous manner along the juncture of the stitch loops of successive or spaced-apart courses of the first layer and provides a technical back side constituting the exposed wear surface of the fabric. The lay-in yarn is in the range of two to ten times larger than the base yarn which constitutes the first layer so that the lay-in yarn substantially covers the first layer. The lay-in yarn may be formed of natural fibers or of synthetic fibers which are unaffected in the heat temperature range at which the base is heat settable. And provides the tactile characteristics, appearance and hand of the lay-in yarn constituting the exposed wear surface of the fabric.

This two-layer fabric is then subjected to finishing procedures which include exposure to heat under closely controlled conditions of temperature, exposure time, etc., so that the fabric is permanently set to specific length and width stability standards, while maintaining desirable aesthetic and tactile features. For automotive, home furnishing, and contract applications, maximum shrinkage in either direction has been established at 5% and maximum gain in either direction at 2%. Finishing may also include the application of flame retardant back coatings, lubricants, and other finishes for the purpose of soil release, sewability, etc. Finishing may also include other conventional surface treatments, such as sanding, shearing, embossing, etc., to enhance the hand, appearance and performance of the upholstery fabric. The desired color may be imparted to the present two-layer upholstery fabric by knitting yarns which are already dyed or the fabric may be knit in the greige for inventory and subsequently piece-dyed to the specific colors in accordance with the orders received for particular colors.

After scouring, piece-dyeing, and other desired types of finishes have been applied to the fabric, the fabric is framed or set to the desired width and length dimensions by constraining the same, as by a pin tenter frame, and passing the fabric through a heat treatment range comprising several ovens under precisely controlled conditions of heat and exposure time so that the fabric takes on a permanent set thereby providing the stability necessary to meet established standards in upholstery fabrics. The amount of heat to which the two-layer fabric is exposed during the heat setting operation will be sufficient to heat set the lighter thermoplastic base yarn forming the first layer and the technical face side of the fabric while the character of the lay-in yarn forming the second layer and the technical back side of the fabric is such that the heat treatment does not adversely affect it. Therefore, the exposed wear surface of the fabric will not become harsh or brittle but rather will retain the desirable tactile characteristics, appearance and hand of the lay-in yarn.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
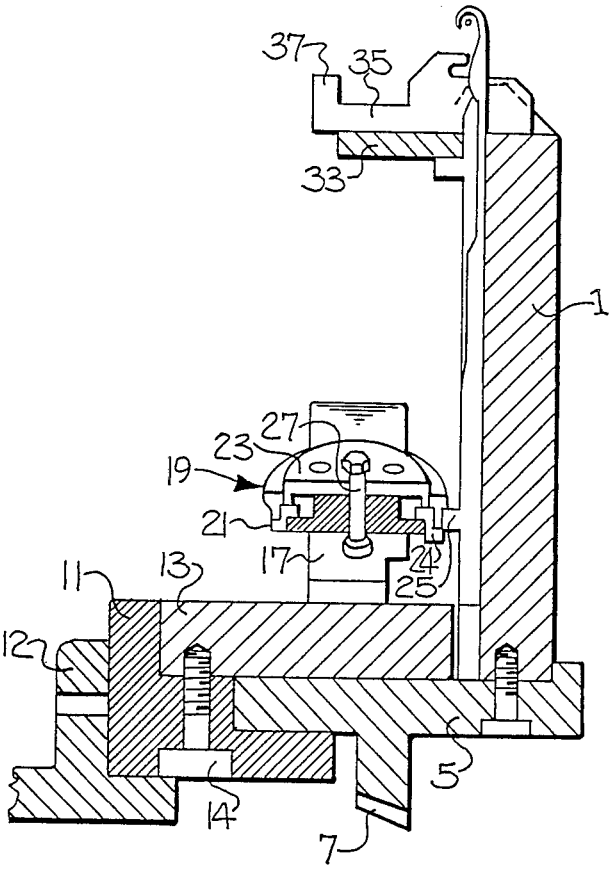
FIG. 1 is a vertical sectional view through one type of conventional circular knitting machine on which fabrics of the present invention may be knit.

The circular knitting machine illustrated in FIG. 1 is of the conventional sinker top construction type and includes a slotted needle cylinder 1 for receiving a plurality of vertically movable latch needles N therein. The needle cylinder 1 is fixed on the inner portion of an annular gear ring 5 which is driven in the usual manner by a ring gear 7 and suitable gearing, not shown. The outer peripheral portion of the gear ring 5 is rotatably supported on a ledge around the inner surface of a bed plate 11 and is held in position by a retaining ring 13 supported on the upper shoulder of the bed plate 11 by screws 14. The bed plate 11 is supported around its outer peripheral portion on a machine frame member 12.

Figure 2:
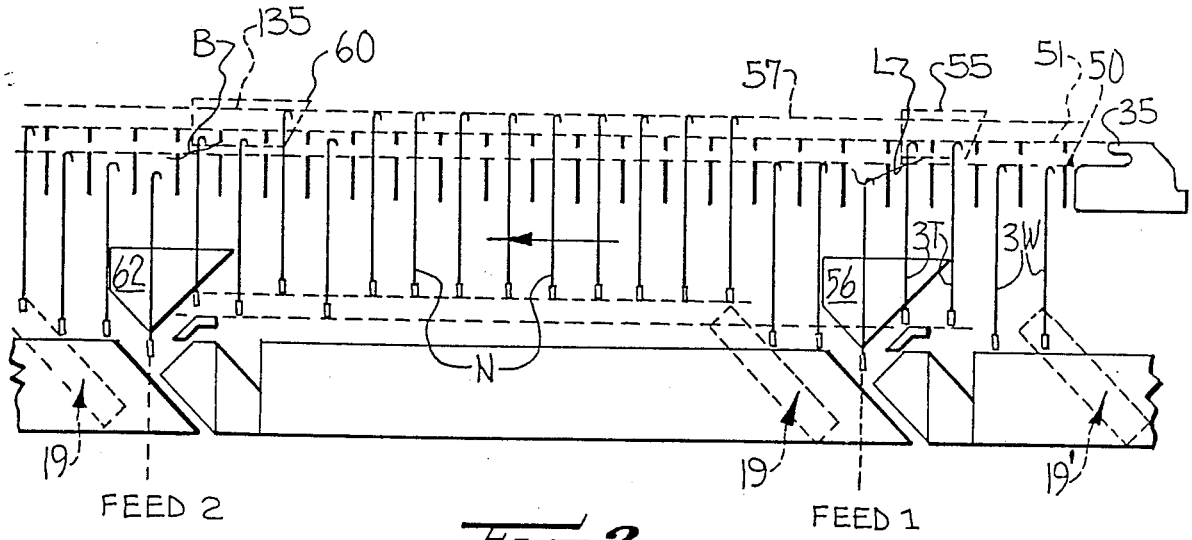
FIG. 2 is a developed elevational view of the cams surrounding the needle cylinder and illustrating the manner in which the lay-in yarn is fed to the needles at one station or feed and the body yarn is fed to the needles at a successive knitting station or feed.

A conventional three-position pattern wheel, broadly indicated at 19 in FIGS. 1 and 2, is provided in advance of each yarn feeding station for selectively positioning the needles N to knit, tuck and welt levels, in a manner to be presently described. The pattern wheel 19 (FIG. 1) is mounted on a bracket 17 for rotational movement about a post 27. Rotational movement is imparted to the pattern wheel 19 by interaction of needle butts 25 of the needles N and pattern wheel slots in a manner well known in the art. High and low pattern wheel bits 21 and 24 are selectively placed in the slots provided in the circumference of the pattern wheel 19 and are locked in place by cover plate 23.

When a low pattern wheel bit 24 is present, it cooperates with needle butt 25 to selectively raise the corresponding needle N to a tuck yarn receiving level. If a high pattern wheel bit 21 engages the needle butt 25, it will actuate and raise the cooperating needle N to a knit yarn receiving level. If the pattern wheel slot has no bit inserted, the corresponding needle N will remain unselected so that the needle will be maintained at a lower welt or miss position, such that the yarn introduced will be floated behind the unselected needle N.

Cooperating with the needles N in machines of the sinker top construction type is a radially slotted sinker dial 33 fixedly mounted on the upper end of the needle cylinder 1. Sinkers 35 are actuated in radial slots of the sinker dial 33 by conventional sinker cams, not shown, operative on sinker butts 37. The inward and outward radial movement of the sinkers 35 is synchronized with the vertical movement of the needles in a conventional and well-known manner to form the knit fabric. It is to be understood that other conventional types of needle selection means may be utilized rather than the particular pattern wheels 19 illustrated in the drawings.

Figure 3:
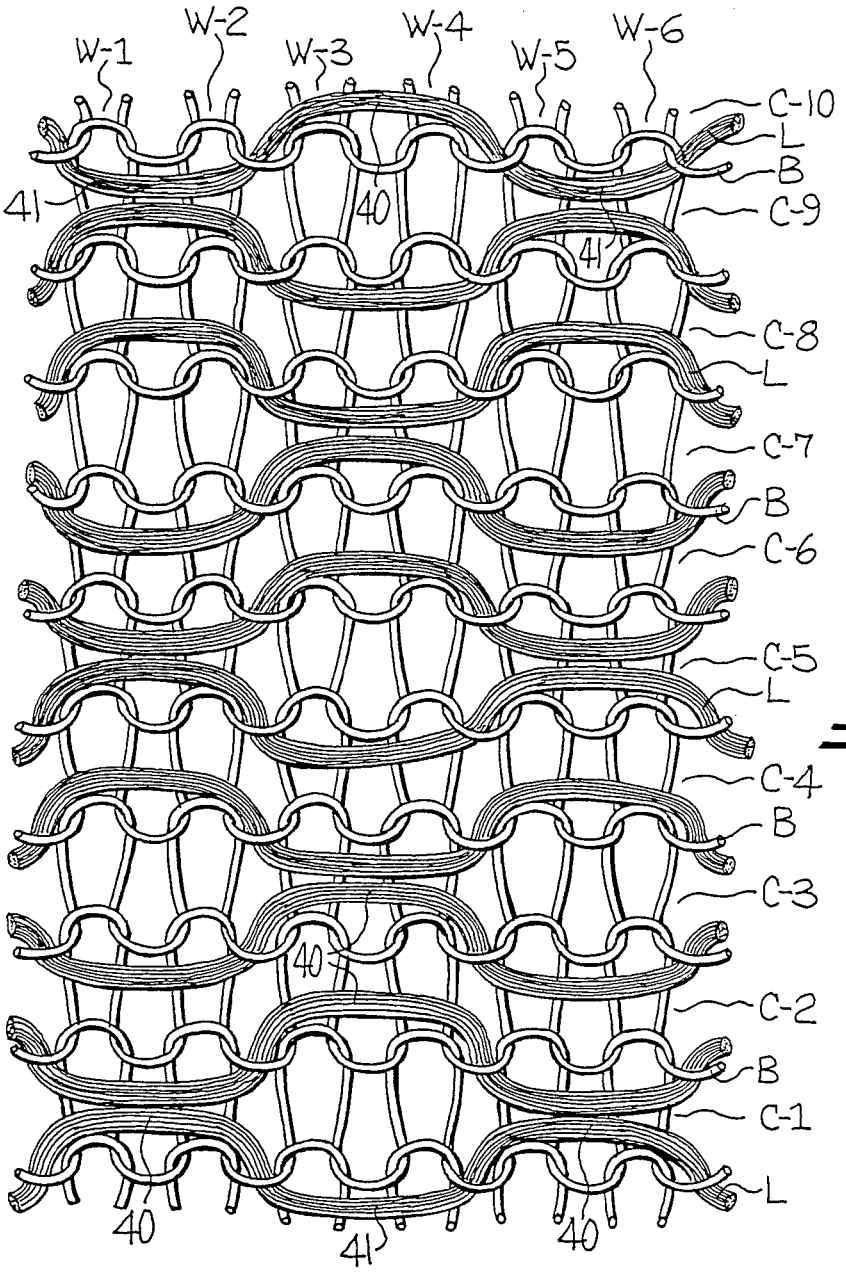
FIG. 3 is a greatly enlarged and somewhat schematic elevational view of a fragmentary portion of one type of knit two-layer upholstery fabric of the present invention, as viewed from the technical back side of the fabric.

One type of circular knit two-layer upholstery fabric is illustrated in FIG. 3, as viewed from the technical back side thereof, and encompassing wales W-1 through W-6 and courses C-1 through C-10. The two-layer upholstery fabric of FIG. 3 includes a first layer knit of thermoplastic base yarn B forming jersey stitch loops in wales of successive courses to provide a technical face side of the fabric. The said thermoplastic heat-settable base yarn may, as noted previously, be nylon, polyester, or polypropylene or blends thereof in percentages sufficiently high so that when exposed to appropriate heat under controlled conditions of temperature and exposure time, a permanent set will be imparted to the base fabric. A second layer is formed of lay-in yarn L extending generally coursewise and in a sinuous manner along the juncture of the stitch loops of successive or spaced-apart courses of the first layer and providing a technical back side constituting the exposed wear surface of the fabric.

As illustrated in FIG. 3, the lay-in yarn L is much larger than the base yarn B and is preferably in the range of from two to ten times larger than the base yarn so that the lay-in yarn L substantially covers the base yarn. The lay-in yarn may be formed of natural fibers or of synthetic fibers which are unaffected in the heat temperature range at which the base yarn is heat settable. And provides the tactile characteristics, hand and appearance of the lay-in yarn constituting the exposed wear surface of the upholstery fabric. The lay-in yarn L, in FIG. 3, is incorporated in the fabric along the juncture of the stitch loops of successive courses in what is generally termed a 2×2 manner to alternately form tuck floats 40 and welt floats 41. As illustrated in FIG. 3, the tuck floats 40 and the welt floats 41 are formed in the same wales in a pair of successive courses and are then staggered walewise during the knitting of the next pair of successive courses. In each instance, the floats 40 and 41 are illustrated as extending across two adjacent wales. It will be appreciated that lay-in yarn L may be incorporated in the fabric in selected courses, not necessarily successive courses, as shown in FIG. 3. Furthermore, lay-in yarn L may be selectively introduced to provide other tuck/welt combinations in overall, jacquard, or random combinations on the technical back side of the fabric.

The knitting of the fabric of FIG. 3 will be described in connection with the stitch cam layout of FIG. 2 in which the pattern wheel 19′ in advance of feed 1 is operable to either permit the needles N to remain at a lower welt or miss position, as indicated by the dotted line 50, or to raise the same to tuck level, as indicated by the dotted line 51. The needles N are thus raised to tuck level or remain in the welt position as they approach a yarn carrier 55 feeding a lay-in yarn L to the hooks of the needles which are raised to the tuck level. Those needles N which are not selected by the pattern wheel 19' remain in the lowered position shown so that their hooks pass beneath the feeding point for the lay-in yarn L and the yarn extends across inside of these needles as the butts 25 of the needles engage a stitch cam 56 and are lowered thereby.

To form the fabric shown in FIG. 3, alternate pairs of adjacent needles N are raised by pattern wheel means 19' to the tuck level 51 while intervening pairs of adjacent needles N remain at the lower welt level 50. Needles N are then raised by the next pattern wheel 19 so that the hooks of needles so raised to the knit level, indicated by the dotted line 57, pick up a base yarn B as it is fed through a yarn feed finger 60. The base yarn B is then knit as the needle butts 25 engage and are lowered by a stitch cam 62, forming a course of jersey knit stitches, such as illustrated at C-1 in FIG. 3. As this course C-1 is formed, stitch loops of the previous course are shed or cast off and the lay-in yarn L forms tuck floats 40 in wales W-1, W-2 and W-5, W-6 while forming a welt float 41 in wales W-3 and W-4.

At the next succeeding lay-in station, the intervening pairs of adjacent needles N are raised to the tuck level while the alternate pairs of adjacent needles N remain at the welt level so that a tuck float 40 is formed in wales W-3 and W-4 while welt floats 41 are formed in wales W-1, W-2 and W-5, W-6 as the course C-1 is shed from the needles. The lay-in yarn L is incorporated at the juncture of the courses C-2 and C-3 in the same manner as the lay-in yarn L is incorporated at the juncture of the courses C-1 and C-2 so that a tuck float 40 is formed in wales W-3 and W-4 while welt floats 41 are formed in the wales W-1, W-2 and W-5, W-6. The lay-in yarn L is incorporated in the fabric at the junctures of the courses C-3, C-4 and C-4, C-5 in the same manner as the lay-in yarn L was incorporated in the course C-1 and one pattern repeat is completed when the course C-5 is knit. The lay-in yarn L is incorporated in the succeeding courses C-5 through C-10 in the same manner as the lay-in yarn L is incorporated in the courses C-1 through C-5. The tuck floats 40 and the welt floats 41 of the lay-in yarn L are disposed on the technical back side of the fabric which constitutes the exposed wear surface. The large lay-in yarn L substantially covers the smaller base yarn B to provide the tactile characteristics, appearance and hand of the lay-in yarn L on the exposed wear surface of the fabric. As noted previously, needle selection means makes possible the development of various tuck/welt combinations on the technical back side of the fabric to enhance the functional and aesthetic characteristics of the resultant fabric.

Figure 4:
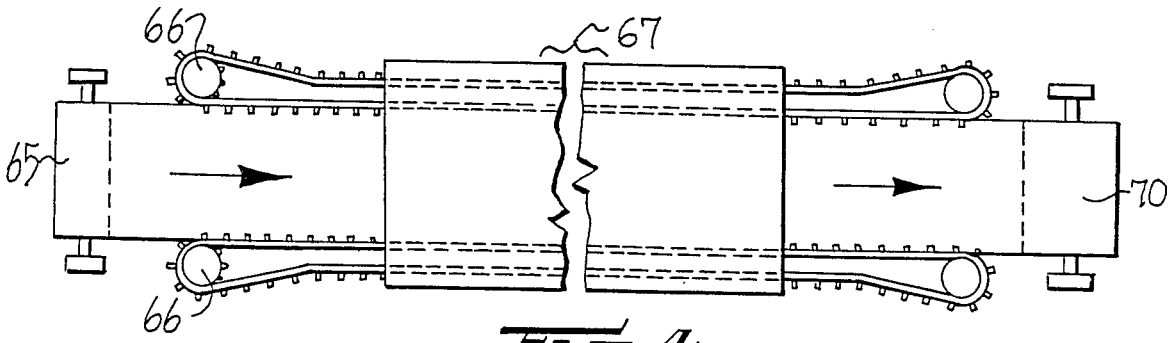
FIG. 4 is a somewhat schematic plan view of a pin tenter frame and illustrating the present two-layer upholstery fabric being subjected to a heat setting treatment thereby.

Upon completion of the knitting of the fabric, it is subjected to various finishing procedures, such as scouring, application of flame retardant, soil release, and lubricant treatments, and the like, and it is then stabilized. The fabric is stabilized by feeding the fabric from a supply roll 65 (FIG. 4) and onto pins carried by tenter frame chains 66 to expand the same in a coursewise direction. The chains 66 transport the fabric through heater ovens 67 and the fabric is then rolled up on a take-up roll 70. The fabric is in the heat chamber 67 a sufficient length of time to heat set the thermoplastic base yarn B and to stabilize the same.

More specifically, after the tubular fabric has been wet-processed, i.e., piece-dyed, etc., and slit into open width form, the controlled conditions, to which reference is made above, include the following:

1. Impaling the fabric along both slit edges on the pins of a tentering frame at relaxed fabric width with zero or minimal fabric overfeed;

2. While still secured on the pins, drawing out the fabric, widthwise, to a desired predetermined dimension, and introducing the fabric, while so controlled, into the leading end of a heat-treatment range comprising independent ovens set to progressively higher temperatures in successive stages.

For example, if the thermoplastic base yarn component includes polyester and/or nylon, and four (4) successive ovens constitute the heat-treatment range, the first oven may have a temperature setting of 300°/320° F.; the second oven, 320°/340° F.; the third oven, 340°/360° F.; and the final oven, 360°/380° F.

If the thermoplastic base yarn component is polypropylene, then the first oven may have a temperature reading of 200°/220° F.; the second oven, 220°/240° F; the third oven, 240°/260° F.; and the final oven, 260°/280° F. If a greater number of ovens is utilized, the temperature will be gradually increased in the same proportion as set forth above.

If the knitted fabric includes yarns with different thermoplastic properties, for example, polypropylene for the ground yarn and nylon or polyester for the lay-in or effect yarn, heat-setting the fabric with respect to the polypropylene component will stabilize the ground or substrate fabric and not affect the nylon or other thermoplastic component whose heat-setting temperature is well above that of the polypropylene. Therefore, the technical back side of the fabric, the so-called exposed or wear surface, will not become harsh or brittle but rather will retain its soft hand.

3. The speed at which the fabric is passed through the heat-treatment range is determined by fabric type, fabric condition, length of each oven, etc. In fabrics of the present invention incorporating a polyester and/or nylon component, an exposure time of approximately 30/45 seconds at the final oven temperature of 360°/380° F. is adequate to achieve dimensional stability.

When polypropylene constitutes the thermoplastic component, an exposure time of approximately 30/45 seconds at the final oven temperature of 260°/280° F. is suitable to achieve dimensional stability adequate for upholstery applications. After the fabric is stabilized, it may be back coated on the technical face side, if desired.

As a specific but nonlimiting example, it has been found that a satisfactory circular knit two-layer upholstery fabric can be knit with the stitch construction illustrated in FIG. 3. A 1/400/68 denier textured set polyester yarn is utilized as the base yarn B and a 1/1,000/80 air entangled nylon yarn is utilized as the lay-in yarn L. Thus, the lay-in yarn L is two and one-half times as large as the base yarn B. After knitting, this fabric is passed through a tenter frame device of the type shown in FIG. 4 to heat set the base fabric in the temperature ranges set forth above.

This fabric is knit on a 16 cut circular machine, includes 39 courses per inch and 29 wales per inch, and is found to have a maximum shrinkage of five percent in either direction and a maximum gain of two percent in either direction. If desired, the stabilized two-layer upholstery fabric can then be subjected to a coating operation on the technical face side.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A circular knit two-layer fabric having stability and limited stretchability in both course wise and walewise directions and being particularly adapted for use as upholstery and the like, said fabric comprising a first layer knit of thermoplastic base yarn and forming stitch loops in wales of successive courses to provide a technical face side of said fabric, and a second layer formed of lay-in yarn extending generally coursewise and in a sinuous manner along the juncture of the stitch loops of certain courses of said first layer and providing a technical back side constituting the exposed wear surface of the fabric, said lay-in yarn alternately forming tuck floats and welt floats extending across pairs of adjacent wales and along the juncture of the stitch loops of successive courses of said first layer, said tuck floats and said welt floats in adjacent pairs of courses being staggered relative to the corresponding tuck floats and welt floats in adjacent pairs of courses, and said lay-in yarn being in the range of two to ten times larger than said base yarn so that said lay-in yarn substantially covers said base yarn and provides the tactile characteristics and hand or said lay-in constituting the exposed wear surface of the fabric.

2. A circular knit two-layer fabric according to claim 1 wherein said lay-in yarn is two and one-half times larger than said base yarn.

3. A circular knit two-layer fabric according to claim 1 wherein said thermoplastic base yarn comprises polyester, and wherein said lay-in yarn comprises nylon.

4. A circular knit two-layer fabric according to claim 1 wherein said thermoplastic base yarn comprises polypropylene.

5. A circular knit two-layer fabric according to claim 1 wherein said thermoplastic base yarn comprises continuous synthetic filaments and said lay-in yarn comprises natural fibers.

6. A circular knit two-layer fabric according to claim 1 wherein said base yarn is heat settable at a lower temperature than said lay-in yarn so that said fabric can be heat stabilized and permanently set to limit the stretchability of the fabric while maintaining the characteristics of the lay-in yarn forming said second layer and constituting the exposed wear surface of the fabric.

7. A circular knit two-layer fabric according to claim 1 whereby said fabric can be heat stablized and permanently set to a maximum shrinkage of five percent in either direction and a maximum gain of two percent in either direction.

8. A circular knit two-layer fabric having stability and limited stretchability in both coursewise and walewise directions and being particularly adapted for use as upholstery and the like, said fabric comprising a first layer knit of thermoplastic base yarn of a particular size and being heat settable at a predetermined temperature, said base yarn forming stitch loops in wales of successive courses to provide a technical face side of said fabric, and a second layer formed of lay-in yarn of between two to 10 times larger than said base yarn and extending generally coursewise and in a sinuous manner along the juncture of the stitch loops of courses of said first layer, and providing a technical back side constituting the exposed wear surface of the fabric, said lay-in yarn alternately forming tuck floats and welt floats extending across pairs of adjacent wales and along the juncture of the stitch loops of successive courses of said first layer, said tuck floats and said welt floats in adjacent pairs of courses being staggered relative to the corresponding tuck floats and welt floats in adjacent pairs of courses, and said larger lay-in yarn being unaffected in the heat temperature range at which said base yarn is heat settable whereby said fabric is heat stabilized and permanently set to limit the stretchability of said first layer while maintaining the tactile characteristics and hand of said lay-in yarn constituting the exposed wear surface of the fabric.

9. A circular knit two-layer fabric according to claim 8 wherein said thermoplastic base yarn is polyester and heat settable in the 360°/380° F. temperature range.

10. A circular knit two-layer fabric according to claim 8 wherein said thermoplastic base yarn is polypropylene and heat settable in the 260° /280° F. temperature range.

11. A circular knit two-layer fabric according to claim 11 wherein said thermoplastic base yarn comprises polyester, and wherein said lay-in yarn comprises nylon.

12. A circular knit two-layer fabric according to claim 8 wherein said lay-in yarn comprises a natural fiber.

13. A circular knit two-layer fabric according to claim 8 wherein said thermoplastic base yarn comprises polypropylene.

14. A method of producing a circular knit two-layer fabric having stability and limited stretchability in both coursewise, and walewise directions and being particularly adapted for use as upholstery and the like, said method comprising the steps of knitting a first layer of thermoplastic base yarn while forming stitch loops in wales of successive courses to provide a technical face side of the fabric, while forming a second layer formed of lay-in yarn being in the range of two to ten times larger than said base yarn and extending generally coursewise and in a sinuous manner along the juncture of the stitch loops of certain course of the first layer to provide a technical back side constituting the exposed wear surface of the fabric, and slitting the fabric into open width form and impaling the slit edges on the pins of a tentering frame at relaxed fabric width with minimal fabric overfeed, drawing the open width knit fabric to predetermined dimensions in both walewise and coursewise directions and applying heat to the extended fabric by passing the fabric through successive ovens set to progressively higher temperatures to heat set and stabilize said first layer in the extended condition.

15. A method according to claim 14 including the step of forming jersey stitch loops of said base yarn in each wale of successive courses.

16. A method according to claim 14 including the steps of knitting the first layer of a thermoplastic base yarn heat settable at a predetermined temperature, and forming the second layer of a lay-in yarn heat settable at a higher temperature than the base yarn.

17. A method according to claim 16 wherein the second layer of lay-in yarn is unaffected by the heat-setting temperature of the thermoplastic base yarn.

18. A method according to claim 14 including the steps of forming tuck floats of the lay-in yarn extending across alternate pairs of adjacent wales of the first layer, and forming welt floats of the lay-in yarn extending across intervening pairs of adjacent wales of the first layer.

19. A method of producing a circular knit two-layer fabric having stability and limited stretchability in both coursewise and walewise directions and being particularly adapted for use as upholstery and the like, said method comprising the steps of knitting a first layer of thermoplastic base yarn while forming stitch loops in wales of successive courses to provide a technical face side of the fabric, while forming a second layer formed of lay-in yarn being in the range of two to ten times larger than said base yarn and extending generally coursewise and in a sinuous manner along the juncture of the stitch loops of certain courses of the first layer to provide a technical back side constituting the exposed wear surface of the fabric, and while forming tuck floats of the lay-in extending across alternate pairs of adjacent wales of the first layer, and forming welt floats of the lay-in yarn extending across intervening pairs of adjacent wales of the first layer, and extending the knit fabric in both walewise and coursewise directions and applying heat to the extended fabric to heat set and stabilize said first layer in the extended condition.

* * * * *

UNITED STATES PATENT AND TRADEMARK OFFICE

CERTIFICATE OF CORRECTION

PATENT NO. : 4,794,767

DATED : January 3, 1989

INVENTOR(S) : Victor J. Lombardi

It is certified that error appears in the above-identified patent and that said Letters Patent are hereby corrected as shown below:

Column 1, line 59, delete "(".

Column 2, line 9, delete "("; line 34, following "base" insert -- yarn --.

Claim 1, line 31, change "or" to -- of --; same line, following "lay-in" insert -- yarn --.

Claim 11, line 2, change "11" to -- 8 --.

Claim 14, line 49, change "course" to -- courses --.

Signed and Sealed this

Twenty-fifth Day of April, 1989

*Attest:*

DONALD J. QUIGG

*Attesting Officer*

*Commissioner of Patents and Trademarks*